United States Patent [19]

Junghans

[11] Patent Number: 4,922,818

[45] Date of Patent: May 8, 1990

[54] WETTING/INKING MECHANISM FOR OFFSET PRINTING PRESSES

[75] Inventor: Rudi Junghans, Wilhelmsfeld, Fed. Rep. of Germany

[73] Assignee: Heidelberger Druckmaschinen Aktiengesellschaft, Heidelberg, Fed. Rep. of Germany

[21] Appl. No.: 288,790

[22] Filed: Dec. 22, 1988

[30] Foreign Application Priority Data

Dec. 22, 1987 [DE] Fed. Rep. of Germany ... 8716847[U]

[51] Int. Cl.[5] ..... B41F 7/26; B41F 7/40; B41F 31/30

[52] U.S. Cl. ..... 101/148; 101/350

[58] Field of Search ..... 101/148, 350, 351, 352, 101/207-210

[56] References Cited

U.S. PATENT DOCUMENTS

| | | | |
|---|---|---|---|
| 3,688,694 | 9/1972 | Preuss et al. | 101/148 |
| 3,749,011 | 7/1973 | Abendroth et al. | 101/148 |
| 3,983,812 | 10/1976 | Schramm | 101/DIG. 38 |
| 4,290,360 | 9/1981 | Fischer | 101/148 |
| 4,440,081 | 4/1984 | Beisel | 101/148 |
| 4,481,882 | 11/1984 | Rudolph | 101/148 |
| 4,524,690 | 6/1985 | Omori | 101/148 |
| 4,660,470 | 4/1987 | Kramp et al. | 101/426 |
| 4,711,172 | 12/1987 | Capdebosc | 101/152 |

FOREIGN PATENT DOCUMENTS

| | | |
|---|---|---|
| 2932105 | 2/1981 | Fed. Rep. of Germany . |
| 3146223 | 3/1985 | Fed. Rep. of Germany . |

*Primary Examiner*—J. Reed Fisher

*Attorney, Agent, or Firm*—Nils H. Ljungman

[57] ABSTRACT

In general, the invention features a mechanism for applying a wetting agent or ink in a printing press, the printing press including a plate cylinder, an ink reservoir and an ink transfer apparatus for transferring the ink from the ink reservoir to the plate cylinder, the ink transfer apparatus including at least a first applicator roller which receives ink from the ink reservoir, the first applicator roller being in contact with the plate cylinder, and a distributor roller, the mechanism including a second applicator roller, a wetting agent reservoir, a wetting agent transfer apparatus for transferring the wetting agent from the wetting agent reservoir to the second applicator roller, and a selective shifting apparatus for selectively shifting the second applicator roller between a first position wherein it contacts both the plate cylinder and the distributor roller and a second position wherein it contacts the plate cylinder but is not in contact with the distributor roller.

15 Claims, 3 Drawing Sheets

WETTING/INKING MECHANISM FOR OFFSET PRINTING PRESSES

BACKGROUND OF THE INVENTION

1. Field of the Invention

The present invention relates to a wetting/inking mechanism for offset printing presses that have a plurality of applicator rolls which correspond to a plate cylinder, the first and second applicator rolls of which, when viewed in the direction of rotation of the plate cylinder, are connected to one another by means of an ink distributing roller. The printing press also has a dip roller which is located in a wetting agent tank, which is in contact with a dosing roller, and which is mounted so that it can move into contact with the first applicator roll.

The disadvantage of known wetting/inking mechanisms which are configured in this manner is that, in all the different inking processes, the wetting agent is transported to the first applicator roll, seen in the direction of rotation of the plate cylinder, and by means of contact between the first ink applicator roll and the distributing roller, ink and wetting agent are always being transferred to the printing plate. As a result, build-up and overflow of ink and/or wetting agent can occur.

2. Description of the Prior Art

German Patent No. 31 46 223 describes a wetting-/inking mechanism for offset printing presses in which there are a total of five applicator rolls for the plate cylinder, the first and second rolls of which, seen in the direction of rotation of the plate cylinder, are connected by means of an intermediate roller. In this device, the wetting mechanism works together with the first applicator roll. The large number of applicator rolls utilized in this design clearly increases its manufacturing costs.

German Laid Open Patent Appln. No. 29 32 105 describes a wetting/inking mechanism in which the first applicator roll, seen in the direction of rotation of the plate cylinder, the distributing roller working together with it, and the dip roller immersed in the wetting agent tank, are mounted in a separate frame. By pivoting this separate frame, the distributing roller can be pivoted toward or away from the second applicator roll. This design already makes possible a separation between the wetting mechanism and the inking mechanism for the processing of certain jobs. However, the design is significantly complex and expensive to implement.

All of the above-mentioned documents are incorporated herein by reference as if the entire contents thereof were fully set forth herein.

OBJECT OF THE INVENTION

One object of the present invention is the provision of a wetting/inking mechanism which can work with an alcohol additive in the wetting agent, such that, even with a narrow printed web, or when printing a small paper format, the buildup of wetting agent leading to the formation of an emulsion with the ink is prevented, and such that a buildup of ink and smearing is significantly reduced.

SUMMARY OF THE INVENTION

This and other objects are achieved by the present invention, wherein the first applicator roll is mounted so that it can be moved away from the ink distributor roll into a second working position. In this position, the applicator roll is used only to apply the wetting agent to the plate of the plate cylinder. Therefore, a very low buildup is achieved, and practically no smearing occurs. In the first working position, in which the applicator roll is in contact with the ink distributor roller, small paper formats or paper printed over only part of its width can be processed without the buildup of ink and wetting agent. Accordingly, by moving the applicator roll toward and away from the ink distributor roller, it is easy for an operator to make an adjustment for special printing jobs.

In the preferred embodiment of the wetting/inking mechanism, the movable wetting rollers are provided with chromium jacket surfaces which produce an additional smoothing of the wetting agent film on the first applicator roll. In addition, as a result of the mounting of the first applicator roll and the wetting roller on provided lever pairs, a stable and precise mounting is achieved, which can be easily adjusted.

In general, the invention features a mechanism for applying a wetting agent or ink in a printing press, the printing press including a plate cylinder, an ink reservoir and an ink transfer apparatus for transferring the ink from the ink reservoir to the plate cylinder, the ink transfer apparatus including at least a first applicator roller which receives ink from the ink reservoir, the first applicator roller being in contact with the plate cylinder, and a distributor roller, the mechanism including a second applicator roller, a wetting agent reservoir, a wetting agent transfer apparatus for transferring the wetting agent from the wetting agent reservoir to the second applicator roller, and a selective shifting apparatus for selectively shifting the second applicator roller between a first position wherein it contacts both the plate cylinder and the distributor roller and a second position wherein it contacts the plate cylinder but is not in contact with the distributor roller.

We turn now to a detailed description of the preferred embodiment of the invention, after first briefly describing the drawings, wherein:

DESCRIPTION OF THE PREFERRED EMBODIMENTS

Figure 1:
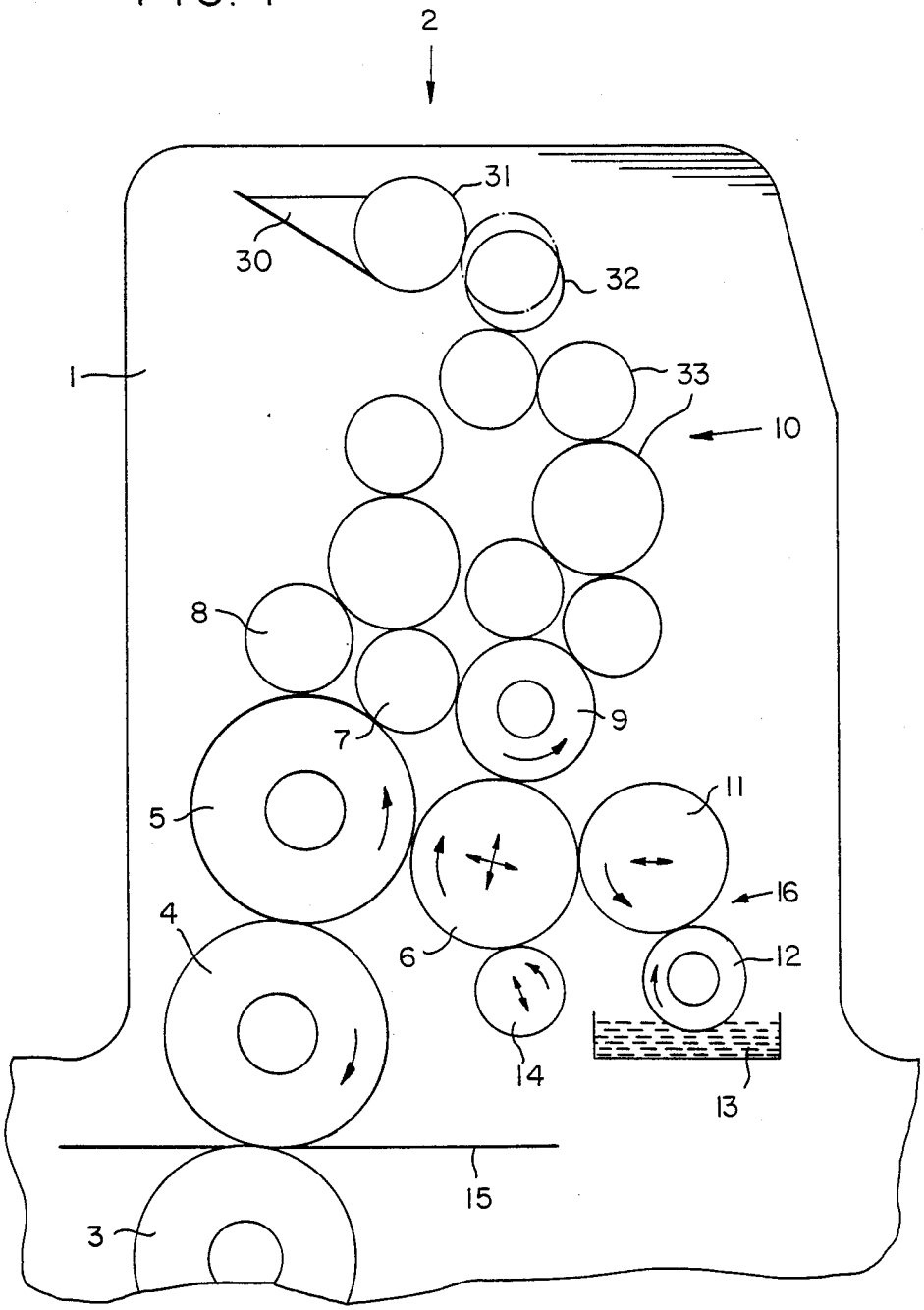
FIG. 1 is a side view of a printing mechanism having a wetting/inking mechanism configured according to the invention.

Referring first to FIG. 1, between the side frames 1 of a printing unit 2, there is provided a printing cylinder 3, a blanket cylinder 4, and a plate cylinder 5. Corresponding to the plate cylinder 5 there are provided applicator rolls 6, 7 and 8, applicator rolls 6 and 7 of which are connected to one another by means of an ink distributor roller 9. The applicator rolls 6 and 8 receive the required amount of ink, in a manner well known in the prior art, by means of an inking mechanism 10.

The inking mechanism 10 generally includes an ink reservoir (or ink duct) 30, a ductor roller 31, a vibrator roller 32 and a plurality of transfer rollers, two of such plurality of transfer rollers being indicated by reference numeral 33. Vibrator roller 32 oscillates between the two positions shown, picking up stripes of ink from ductor roller 31 and transferring them to at least one of the plurality of transfer rollers 33. The ink is then transferred downward through the plurality of transfer rollers 33 toward the applicator rollers, e.g., 6 and 7 and 8. A typical inking mechanism of this type is shown in U.S. Pat. No. 4,660,470 entitled "Inking Unit Pre-Adjustment Method" and issued on Apr. 28, 1987 to Kramp, et al., which patent is incorporated herein by reference as if the entire contents thereof were fully set forth herein.

The first applicator roll (seen in the direction of rotation of the plate cylinder 5) has a doser roller 11, which is mounted so that it can move toward the applicator roll 6. Wetting agent in a wetting agent tank 13 is transported to a doser roller 11 by means of a dip roller 12. Another wetting roller (or distributor roller) 14 with a chromium jacket surface can be selectively moved toward or away from the first applicator roll 6. Such a printing unit 2 can be used to print either sheets or webs 15.

Figure 2:
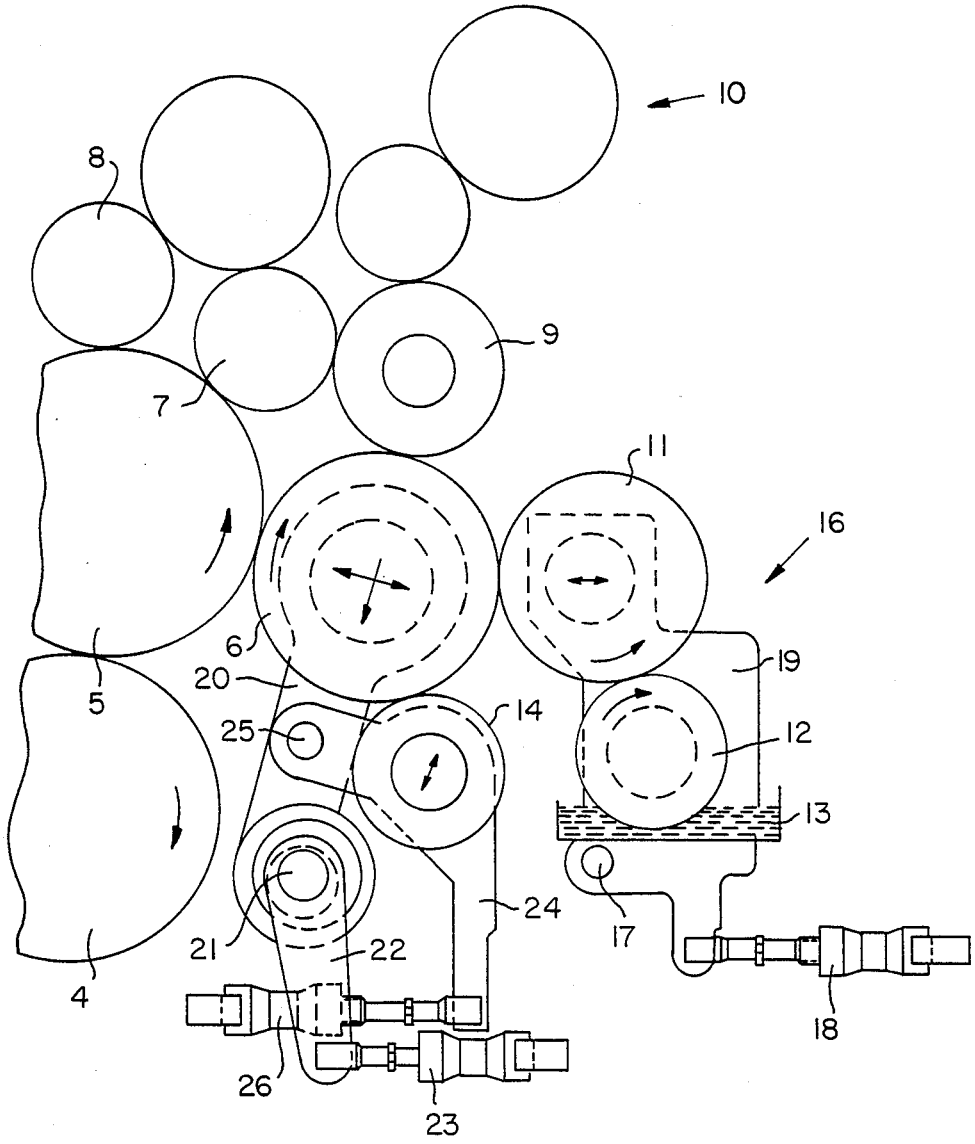
FIG. 2 shows the wetting/inking mechanism of FIG. 1 with the applicator roll in a first position.

FIG. 2 shows the wetting mechanism 16, in which the dosing roller 11 and the dip roller 12 are mounted so that they can pivot around a pivot 17, the pivoting being actuated by means of a pneumatic or hydraulic cylinder 18. As a result of the pivoting, the dosing roller 11 can be moved toward or away from the first applicator roll 6, as required, for example, to start or stop printing. The side parts 19 to hold the dosing roller 11 and the dip roller 12 are located between the side frames 1 of the printing unit 2 on both sides.

Applicator roll 6 can pivot on both sides on a lever pair 20, so that it can be moved toward and away from the plate cylinder 5, initially to start and stop printing. By means of eccentric pivots 21 and levers 22, which are connected to the pivot 21, the eccentric pivots can be pivoted by means of a pneumatically or hydraulically operated cylinder 23 so that the first applicator roll 6 is moved toward the ink distributor roller 9, as shown in FIG. 2, or away from it, as shown in FIG. 3.

Figure 3:
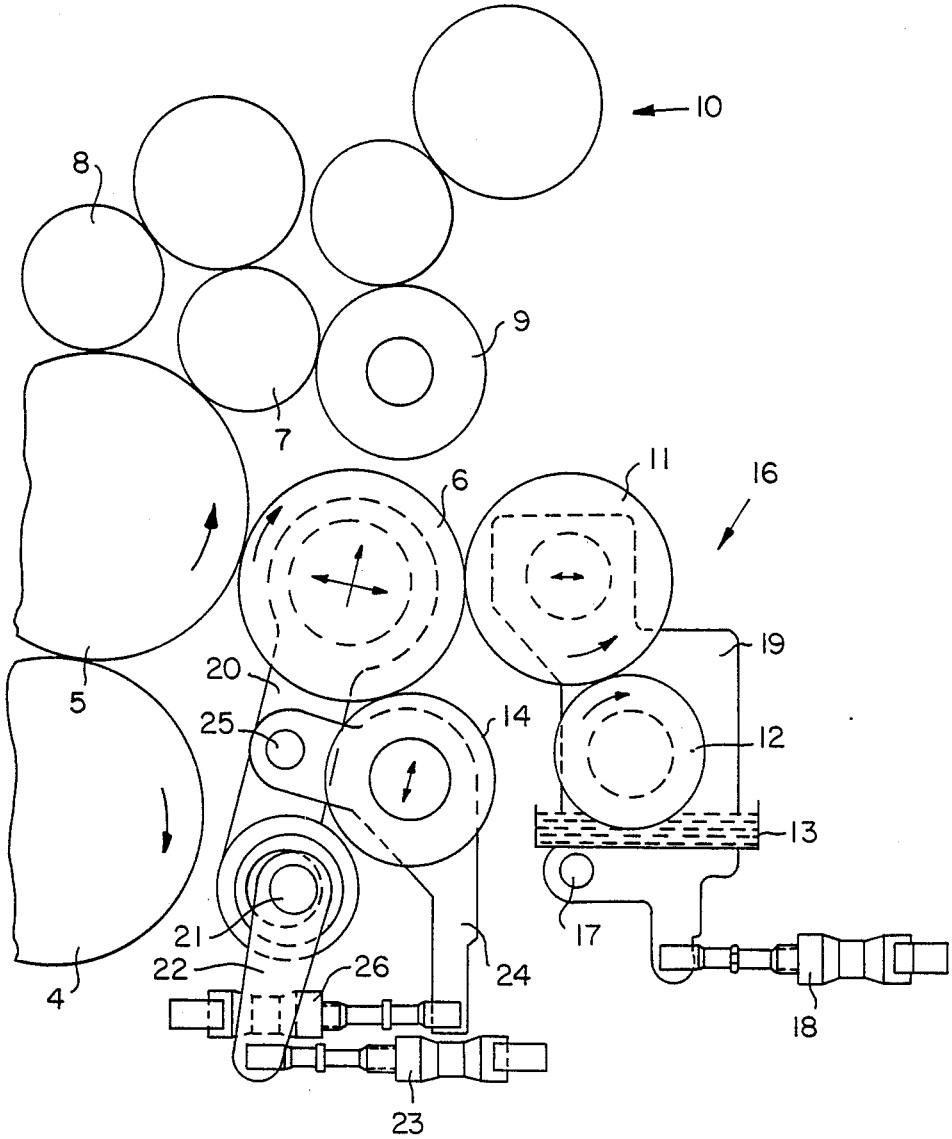
FIG. 3 shows the wetting/inking mechanism of FIG. 1 with the applicator roll in a second position.

Eccentric pivots 21 (there preferably being two, only one or which is visible in the direct side view of FIGS. 2 and 3) are prior art devices which are well known in the mechanical design arts. Essentially they are eccentric cams which convert a lateral movement of the piston rod of pneumatic cylinder 23 into an up and down movement of lever pair 20 and applicator roller 6 which is generally transverse to the lateral movement of the piston rod of pneumatic cylinder 23. Although not shown, other selective positioning means could readily be substituted for eccentric pivots 21, lever arms 22 and pneumatic cylinder 23. For example, a direct push-pull mechanism, such as a pneumatic cylinder can be mounted in-line with or along the longitudinal axis of lever pair 20 so as to effect a direct longitudinal shifting thereof.

In the preferred embodiment shown, the barrel of pneumatic cylinder 23 is secured in a stationary position, for example, by bolting to a portion of the stationary side frame. Accordingly, with the barrel of pneumatic cylinder so secured, and through the action of eccentric pivots (or cams) 21, shifting of the piston rod of pneumatic cylinder 23 between its retracted and expanded positions will result in a shifting of applicator roller 6 between the positions shown in FIGS. 2 and 3, respectively.

Mounted on the lever pair 20, by means of pivots 25, is a second lever pair 24. Mounted in the second lever pair 24 is the wetting roller 14, which in turn can be pivoted by means of a hydraulic or pneumatic cylinder 26 toward or away from the first applicator roll 6. Pneumatic cylinder 26 may be mounted within printing unit 2 in a manner similar to pneumatic cylinder 23 discussed above. By means of the matte chromium jacket surface of the wetting roller 14, it is thereby possible to smooth out the wetting agent film on the applicator roll 6, if such a smoothing is advantageous for certain printing jobs.

Lever pairs 20 and 24 are each a pair of spaced lever arms, with applicator roller 6 being rotatably mounted between lever pair 20, and with wetting roller 14 being rotatably mounted between lever pair 24. In FIGS. 2 and 3 only one lever arm is plainly visible for each of lever pairs 20 and 24, since the second not visible lever arm is positioned directly behind.

Pneumatic (or hydraulic) cylinders, such as pneumatic cylinders 18, 23 and 26 herein, are conventional and well-known mechanical components with which one of ordinary skill in the art of printing press design is familiar. An example of prior art in which pneumatic cylinders are used in the printing press field to selectively shift mechanical components is to be found in U.S. Pat. No. 4,711,172 entitled "Machine Having a Plurality of Working Stations for Successively Processing a Sheet of Material Running Through the Machine" and issued on Dec. 8, 1987 to Capdebosc, which patent is incorporated herein by reference as if the entire contents thereof were fully set forth herein.

As shown in FIG. 2, with the first applicator roll 6 in contact with the driven ink distributor roller 9, printing can be done with contact between the inking and wetting mechanism. Very small formats or very narrow webs can be printed in this configuration, without worrying about the formation of an emulsion in the inking mechanism, if no ink is required in certain areas.

In the configuration illustrated in FIG. 3, in which the first applicator roll 6 is moved away from the ink spreader roller 9, the wetting mechanism works without contact with the inking mechanism, and is used exclusively to transfer wetting agent to the printing plate. The first applicator roll 6 is here used as a pure wetting agent applicator roll and can execute an additional distributing movement (e.g., oscillation) in the axial direction. There are known methods for causing a roller of a printing press to oscillate in an axial direction, one of which is described in U.S. Pat. No. 3,118,373, issued to Mosemiller on Jan. 21, 1964 and entitled "Inker", which U.S. patent is incorporated herein by reference as if the entire contents thereof were fully set forth herein. In this configuration, buildup of ink in the direction of travel is reduced, so that the printing press operator can adjust the wetting/inking mechanism to his printing requirements without a great deal of effort, and can thereby achieve optimum results.

The invention as described hereinabove in the context of a preferred embodiment is not to be taken as limited to all of the provided details thereof, since modifications and variations thereof may be made without departing from the spirit and scope of the invention.

What is claimed is:

1. A mechanism for applying at least one of a wetting agent and an ink in a printing press, said printing press comprising a plate cylinder, ink reservoir means for containing a supply of the ink, and ink transfer means for transferring the ink from said ink reservoir means to said plate cylinder, said ink transfer means comprising:

at least a first applicator roller receiving ink from said ink reservoir means, said first applicator roller being in contact with said plate cylinder, and further a distributor roller comprising a portion of said ink transfer means, said distributor roller receiving ink from said ink reservoir means, said mechanism comprising:

at least a second applicator roller;

wetting agent reservoir means for containing a supply of said wetting agent;

wetting agent transfer means for transferring said wetting agent from said wetting agent reservoir means to said second applicator roller;

selective shifting means for selectively shifting said second applicator roller between at least a first position, wherein said second applicator roller is in contact with said plate cylinder and is also in contact with said distributor roller, and a second position, wherein said second applicator roller is in contact with said plate cylinder and is not in contact with said distributor roller;

a wetting roller separate from said wetting agent transfer means for contacting said second applicator roller; and means for maintaining said wetting roller in contact with said second applicator roller in both said first position, wherein said second applicator roller is in contact with said plate cylinder and is also in contact with said distributor roller, and said second position, wherein said second applicator roller is in contact with said plate cylinder and is not in contact with said distributor roller.

2. A mechanism according to claim 1, wherein said plate cylinder is disposed to rotate, in order, first past said second applicator roller, next past said distributor roller, and finally past said first applicator roller.

3. A mechanism according to claim 1, wherein said wetting agent transfer means comprises a dip roller in contact with said wetting agent reservoir means and a dosing roller in contact with both of said dip roller and said second applicator roller.

4. A mechanism according to claim 2, wherein said wetting agent transfer means comprises a dip roller in contact with said wetting agent reservoir means and a dosing roller in contact with both of said dip roller and said second applicator roller.

5. A mechanism according to claim 3, wherein said mechanism additionally comprises a second selective shifting means for shifting said wetting roller between a contacting position wherein said wetting roller is contacting said second applicator roller and a noncontacting position wherein said wetting roller is not contacting said second applicator roller.

6. A mechanism according to claim 5, wherein said wetting roller is provided with a chromium surface.

7. A mechanism according to claim 4, wherein said mechanism additionally comprises second selective shifting means for shifting said wetting roller between a contacting position wherein said wetting roller is contacting said second applicator roller and a noncontacting position wherein said wetting roller is not contacting said second applicator roller.

8. A mechanism according to claim 7, wherein said wetting roller is provided with a chromium surface.

9. A mechanism according to claim 7, wherein said second applicator roller rotates, in order, first past said dosing roller, next past said wetting roller, and then past said plate cylinder.

10. A mechanism according to claim 9, wherein said wetting roller is provided with a chromium surface.

11. A mechanism according to claim 1, further comprising means for causing said second applicator roller to oscillate in a direction substantially parallel to its longitudinal axis.

12. A mechanism according to claim 3, further comprising additional shifting means for shifting said dosing roller between an active position wherein said dosing roller contacts said second applicator roller and an inactive position wherein said dosing roller is not in contact with said second applicator roller.

13. A mechanism according to claim 5, further comprising additional shifting means for shifting said dosing roller between an active position wherein said dosing roller contacts said second applicator roller and an inactive position wherein said dosing roller is not in contact with said second applicator roller.

14. A mechanism according to claim 5, wherein said second applicator roller is rotationally mounted on at least a pair of applicator roller lever arms, and wherein said selective shifting means for said applicator roller comprises an eccentric pivot coupling said pair of lever arms with at least one hydraulic cylinder.

15. A mechanism according to claim 14, wherein said wetting roller is mounted on at least a pair of wetting roller lever arms, said wetting roller lever arms being pivotally connected to said applicator arms, and wherein said second selective shifting means comprises at least one pneumatic cylinder for pivoting said wetting roller lever arms with respect to said applicator roller lever arms.

* * * * *